United States Patent [19]

Campbell et al.

[11] 4,061,481

[45] Dec. 6, 1977

[54] NATURAL GAS PROCESSING

[75] Inventors: Roy E. Campbell; John B. Lawrence; Ronald Ray Tonne, all of Midland, Tex.

[73] Assignee: The Ortloff Corporation, Midland, Tex.

[21] Appl. No.: 723,513

[22] Filed: Sept. 15, 1976

Related U.S. Application Data

[63] Continuation of Ser. No. 516,993, Oct. 22, 1974, abandoned.

[51] Int. Cl.[2] ..... F25J 3/02

[52] U.S. Cl. ..... 62/29; 62/31; 62/33; 62/34; 62/38

[58] Field of Search ..... 62/9, 11, 17, 12, 26, 62/23, 24, 31, 32, 34, 38, 42, 43, 44, 29, 33

[56] References Cited

U.S. PATENT DOCUMENTS

| | | | |
|---|---|---|---|
| 2,557,171 | 6/1951 | Bodle et al. | 62/23 |
| 2,901,326 | 8/1959 | Kurata et al. | 62/12 |
| 3,105,855 | 10/1963 | Meyers | 62/23 |
| 3,702,541 | 11/1972 | Randall | 62/26 |

*Primary Examiner*—Frank W. Lutter
*Assistant Examiner*—Frank Sever
*Attorney, Agent, or Firm*—Brumbaugh, Graves, Donohue & Raymond

[57] ABSTRACT

The processing of gas streams containing hydrocarbons and other gases of similar volatility to recover high yields of components such as ethane, propane, and heavier hydrocarbons therefrom by expanding said gas stream in at least two stages through turboexpanders, each stage cooling the gas stream and producing energy in the form of horsepower used to drive a recompressor unit or other mechanical apparatus. Condensed liquids are collected intermediate the expansion stages. Preferably, a supplemental gas cooling stage and condensed liquid recovery occurs following each expansion stage.

10 Claims, 6 Drawing Figures

FUEL GAS
SALES GAS
TO FUEL GAS
DEMETH. REBOILER
37°F
DEMETHANIZER TRIM REBOILER
85°F
COLD GAS/GAS & DEMETHANIZER SIDE REBOILER
-135°F
-107°F
-141°F
-79°F
-142°F
380 PSIA
540 PSIA
550 PSIA
1225 PSIA
-119°F
-74°F
5°F
COOL GAS/GAS
37°F
50°F
29°F
WARM GAS/GAS
71°F
22°F
DEMETHANIZER REBOILER
-30°F
1180 PSIA
530 PSIA
365 PSIA
90°F
1250 PSIA
1650 PSIA
105°F
83°F
225 PSIA
61
62
63
64
65
66
67
68
69
71
72
80
81
82
83
84
85

(From Ninth Edition Of Gas Processors Suppliers Association Engineering Data Book, Reproduced By Permission.)

NATURAL GAS PROCESSING

This is a continuation of application Ser. No. 516,993, filed Oct. 22, 1974, now abandoned.

This invention relates to the processing of gas streams containing hydrocarbons and other gases of similar volatility to remove desired condensable fractions. In particular, the invention is concerned with processing of gas streams such as natural gas, synthetic gas and refinery gas streams to recover most of the propane and a major portion of the ethane content thereof together with substantially all of the heavier hydrocarbon content of the gas.

Gas streams containing hydrocarbons and other gases of similar volatility which may be processed according to the present invention include natural gas, synthetic gas streams obtained from other hydrocarbon materials such as coal, crude oil, naphtha, oil shale, tar sands, and lignite. The major hydrocarbon components of natural gas are methane and ethane, with lesser amounts of the relatively heavier hydrocarbons such as propane, butane, pentane, and the like. A typical analysis of a natural gas stream to be processed in accordance with the invention would be, in approximate mol%, 80% methane, 10% ethane, 5% propane, 0.5% iso-butane, 1.5% normal butane, 0.25% iso-pentane, 0.25% normal pentane, 0.5% hexane plus, with the balance made up of nitrogen and carbon dioxide. Sulfur-containing gases, helium and hydrogen are also often found in natural gas.

Recent substantial increase in the market for the ethane and propane components of natural gas has provided demand for processes yielding higher recovery levels of these products. Available processes for separating these materials include those based upon cooling and refrigeration of gas, oil absorption, refrigerated oil absorption, and the more recent cryogenic processes utilizing the principle of gas expansion through a mechanical device to produce power while simultaneously extracting heat from the system. Depending upon the pressure of the gas source, the richness (ethane and heavier hydrocarbons content) of the gas and the desired end products, each of these prior art processes or a combination thereof may be employed.

The cryogenic expansion type recovery process is now generally preferred because it provides maximum simplicity with ease of start up, operating flexibility, good efficiency, safety, and good reliability. U.S. Pat. Nos. 3,360,944, 3,292,380, and 3,292,381 describe relevant processes.

It has now been found that processing of gas streams such as natural gas by using expansion through at least two separate stages and preferably with cooling between stages provides a flexible combination of advantages which include, for constant recovery of desired liquids, significantly reduced energy requirements, or, for a constant energy requirement, significantly improved yields. In addition, both advantages can be obtained under certain conditions. Furthermore, by expanding through at least two stages, a higher propane recovery is obtained for a constant level of ethane recovery. This increase in propane recovery is more significant at lower levels of ethane recovery when compared to recoveries achieved using prior art single stage expansion processes. Expansion of the gas stream through at least two stages with interstage cooling permits design of processes for liquid recoveries at pressure/temperature conditions which avoid regions where prediction of results is difficult. The process of the invention provides flexibility to adjust the design conditions to pressure/temperature regions at which more predictable operating results can be achieved while maintaining higher ethane and propane recoveries or reduced energy requirements.

It is recognized that on occasion, manufacturers of gas expanding equipment recommend, for purely mechanical considerations, that expansion be accomplished through two stages. The criteria usually applied is that where the rotor tip speed in a single stage installation exceeds about 1100 feet per second, a two-stage design would be recommended. A similar recommendation would be made should the design specify an expansion ratio in excess of about 10:1. These criteria are established by the equipment manufacturers to insure a reasonable operating life for the expanders. Another reason for recommending more than one stage is the possible improvement expected in mechanical efficiency. It was unexpected, therefore, to find that substantial advantages were obtained using expansion through at least two stages, and in cases where rotor tip speeds of less than 1100 feet per second and expansion ratios of 5:1 or less were being used.

Thus, the process of the present invention provides an improved yield or reduced energy requirement by expanding a gas stream from a previously existing pressure to a lower pressure in at least two stages, with recovery of condensed liquid occuring between the two expansion stages. Preferably, the gases undergoing expansion are subjected between the separate stages to further cooling by heat exchange relationship to further liquefy certain fractions, followed by recovery of the condensed liquid before the gas stream flows to the next succeeding expander.

The invention will be further described by reference to the accompanying drawings in which flow diagrams of the prior art and of the process of this invention are given.

Referring to the drawings.

Figure 1:
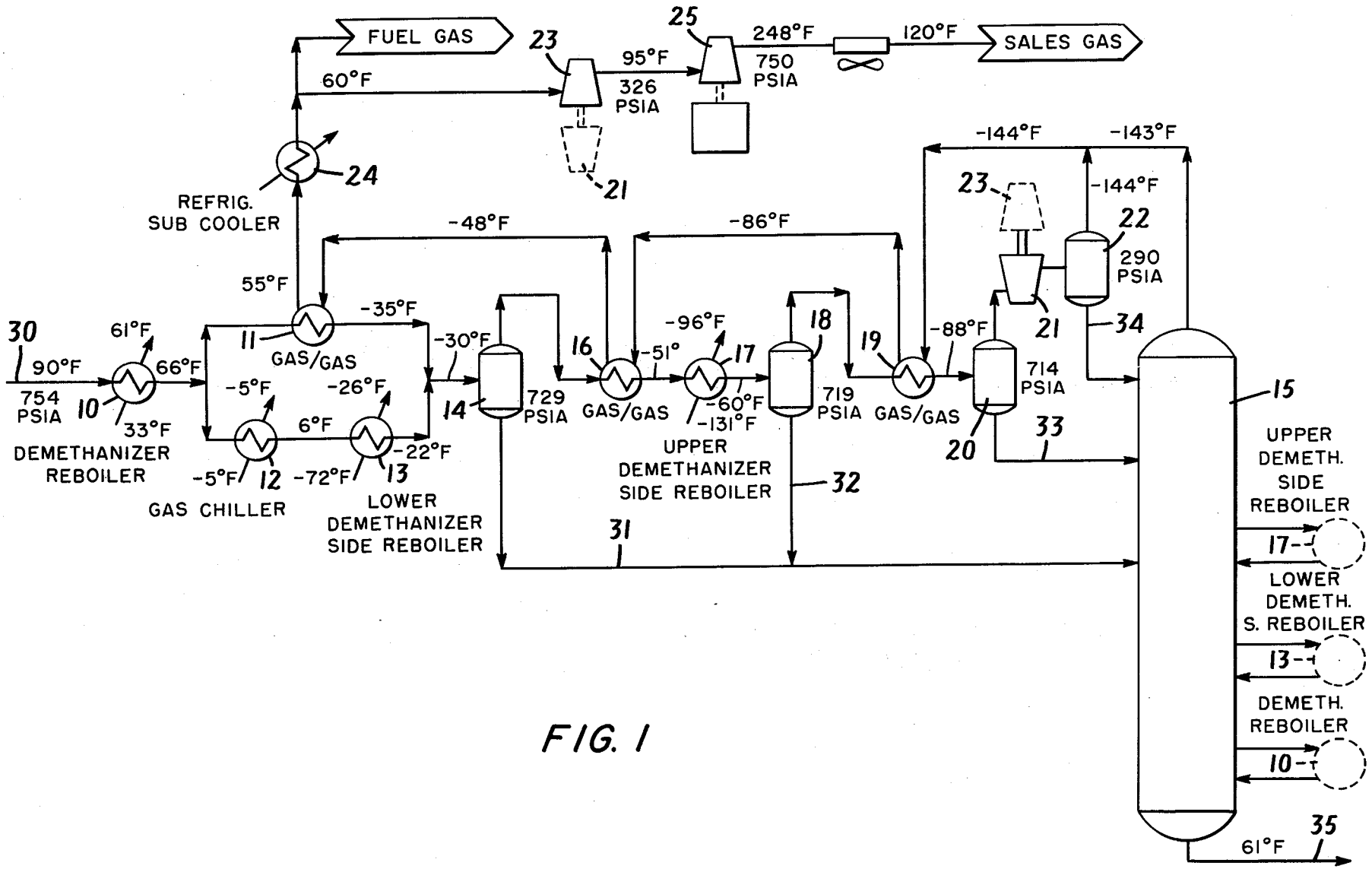
FIG. 1 is a flow diagram of a single stage cryogenic expander natural gas processing plant of the prior art.

Following the process of FIG. 1, plant inlet gas which has been dehydrated at an earlier stage enters the process at 90° F and 754 psia. It is then cooled to 66° F by passing it through demethanizer reboiler 10, the inlet gas in turn providing sufficient heat to produce a demethanized liquid product. The cooled gas is then divided into two parallel streams, as it is further chilled to −30° F by heat exchange with cooled residue gas at −48° F, exchanger 11, −5° F propane refrigerant, exchanger 12, and −72° F demethanizer liquid, reboiler 13. From these exchangers the streams recombine and enter a high pressure separator 14 where the condensed liquid is separated and fed on level control to the demethanizer, 15.

From the high pressure separator 14, the cooled gas flows in heat exchange relationship, with the cooled residue gas at −86° F, exchanger 16 and is reduced to a temperature of −51° F. It then passes to upper demethanizer side reboiler 17 where its temperature is further reduced to −60° F. The gas stream then flows to a second high pressure separator 18, where the condensed liquid is separated on level control and combined with the condensed liquid stream from separator 14 and carried to demethanizer, 15.

The cooled gas then flows from high pressure separator 18 to a gas heat exchanger 19 where it exchanges heat with the cold residue gas at −144° F. The cooled gas then flows at −88° F and still at a pressure of 714 psia to a third high pressure separator 20 where the condensed liquid is separated and taken to demethanizer 15 where it is introduced at an intermediate level on the column. From the high pressure separator 20, the cooled gas flows through expander 21 where because of work expansion from 714 to 290 psia, the gas is chilled to −144° F. Expander may be a turboexpander, having a compressor 23 mounted on the expander shaft. Liquid condensed during expansion is separated in low pressure separator 22. The condensed liquid is fed on level control to the demethanizer column at the top and flows from the chimney tray (not shown) as top feed to the column.

As liquid fed to demethanizer 15 flows down the column, it is contacted by vapors which strip the methane from the liquid to produce a demethanized liquid product. The heat needed to generate stripping vapors is obtained by heat exchange with inlet gas in the three exchangers, 10, 13, and 17.

The vapors stripped from the condensed liquid at demethanizer 15 join the cooled outlet gas from low pressure separator 22. The combined residue gas at −144° F then flows back through exchangers 19, 16, 11, and 24.

A portion of the discharge gas is used as fuel while the balance is recompressed to a gas discharge pressure of 750 psia, and the discharge gas from compressor 25 is cooled to 120° F before it is returned to the sales gas line.

Inlet and liquid component flow rates, outlet liquid recovery efficiencies and expansion/compression requirements are given in the following table:

Table I

Stream Flow Rate Summary - Lb. Moles/Hr.

| Stream | Methane | Ethane | Propane | Butanes+ | Total |
|---|---|---|---|---|---|
| 30 | 19,023 | 1,333 | 586 | 477 | 21,959 |
| 31 | 580 | 208 | 227 | 363 | 1,387 |
| 32 | 400 | 121 | 106 | 73 | 705 |
| 33 | 936 | 144 | 93 | 27 | 1,216 |
| 34 | 1,802 | 558 | 150 | 14 | 2,548 |
| 35 | 22 | 959 | 573 | 476 | 2,047 |

Rcoveries

| | |
|---|---|
| Ethane | 71.9% |
| Propane | 97.7% |

Horsepower

| | BHP At Efficiency |
|---|---|
| Expander/Compressor | 2241 At 80%/73% |
| Final Compressor | 10,189 At 73% |

Figure 2:
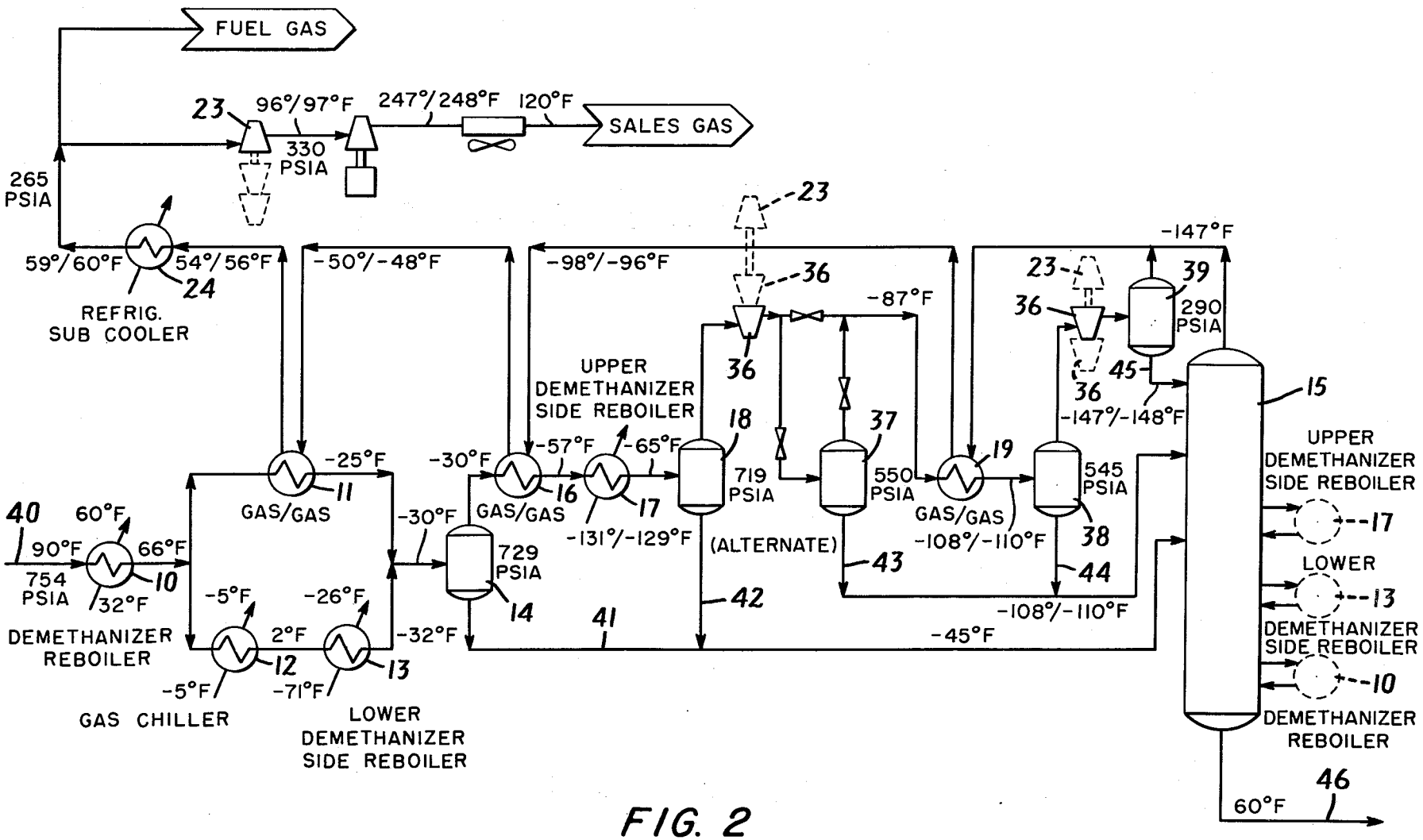
FIG. 2 is a flow diagram showing one embodiment of the present invention, with the addition of a second expansion stage to an intermediate pressure level.

One embodiment of the process of the present invention is shown in FIG. 2. The prior art process shown in FIG. 1 is used to dehydrate and cool the inlet gas to −65° F. The gas at −65° F flows to high pressure separator 18 where condensed liquid therein is separated and fed on level control to the demethanizer 15.

The cold gas component of the inlet stream flows from the high pressure separator 18 through the first stage of expander 36 where because of work expansion from 719 to 550 psia, the gas is chilled to −87° F. Expander 36 is a turboexpander, with two expanders and a compressor 23 mounted on the same shaft. Expander 36 alternatively may be a double expander in a single case.

At this point in the process, the gas stream may follow one of two routes. It may be carried directly to heat exchanger 19 for further cooling. Alternatively, and in many circumstances preferred, the gas stream flows through expander outlet low pressure separator 37 where liquid formed by the expansion through expander 36 is separated on level control. The liquid is combined with liquid from separator 38 and flows to demethanizer 15 as its middle feed.

From the low pressure separator 37, the cold gas stream is then chilled in the cold gas heat exchanger 19 to −110° F, where expander outlet separator 37 is used, or to −108° F where expander outlet separator 37 is not used. This chilled stream then goes to a second low pressure separator 38 where condensed liquid is removed and fed on level control to demethanizer 15 as a feed in the middle of the column. Cold gas leaves separator 38 and flows through the second stage of expander 36 where, because of work expansion from 545 to 290 psia, the gas is chilled to −148° F in the case where expander outlet separator 37 is used, and to −147° F where expander outlet separator 37 is not used. Cold liquid formed by this second expansion is removed as the stream enters separator 39 prior to demethanizer 15 and flows as top feed to the column.

Component flow rates of the inlet gas and of condensed liquids identified at various points in FIG. 2 are given in the following Tables II and III. Table II gives analyses of the streams where the expander outlet separator 37 is not utilized. Table III gives component flow rates of the same streams in the case where expander outlet separator 37 is used.

Component flow rates and other pertinent data are given in the following table:

Table II

Stream Flow Rate Summary - Lb. Moles/Hr

| Stream | Methane | Ethane | Propane | Butanes+ | Total |
|---|---|---|---|---|---|
| 40 | 19,023 | 1,333 | 586 | 477 | 21,959 |
| 41 | 580 | 208 | 227 | 363 | 1,387 |
| 42 | 545 | 152 | 125 | 79 | 909 |
| 43 | N/A | N/A | N/A | N/A | N/A |
| 44 | 2,005 | 423 | 178 | 29 | 2,664 |
| 45 | 1,036 | 281 | 50 | 5 | 1,388 |
| 46 | 21 | 990 | 578 | 476 | 2,082 |

Recoveries

| | |
|---|---|
| Ethane | 74.2% |
| Propane | 98.7% |

Horsepower

| | BHP At Efficiency |
|---|---|
| Expander/Compressor | 2373 At 80%/73% |
| Final Compressor | 10,023 At 73% |

The data for the alternate of this case are given in the following table:

Table III

Stream Flow Rate Summary - Lb. Moles/Hr.

Table III-continued

| Stream | Methane | Ethane | Propane | Butanes+ | Total |
|---|---|---|---|---|---|
| 40 | 19,023 | 1,333 | 586 | 477 | 21,959 |
| 41 | 580 | 208 | 227 | 363 | 1,387 |
| 42 | 545 | 152 | 125 | 79 | 909 |
| 43 | 305 | 109 | 84 | 25 | 526 |
| 44 | 1,381 | 286 | 101 | 8 | 1,796 |
| 45 | 1,180 | 309 | 45 | 2 | 1,553 |
| 46 | 22 | 993 | 579 | 462 | 2,074 |

Recoveries

| | |
|---|---|
| Ethane | 74.5% |
| Propane | 98.8% |

Horsepower

| | BHP at Efficiency |
|---|---|
| Expander/Compressor | 2380 At 80%/73% |
| Final Compressor | 10,032 At 73% |

Figure 3:
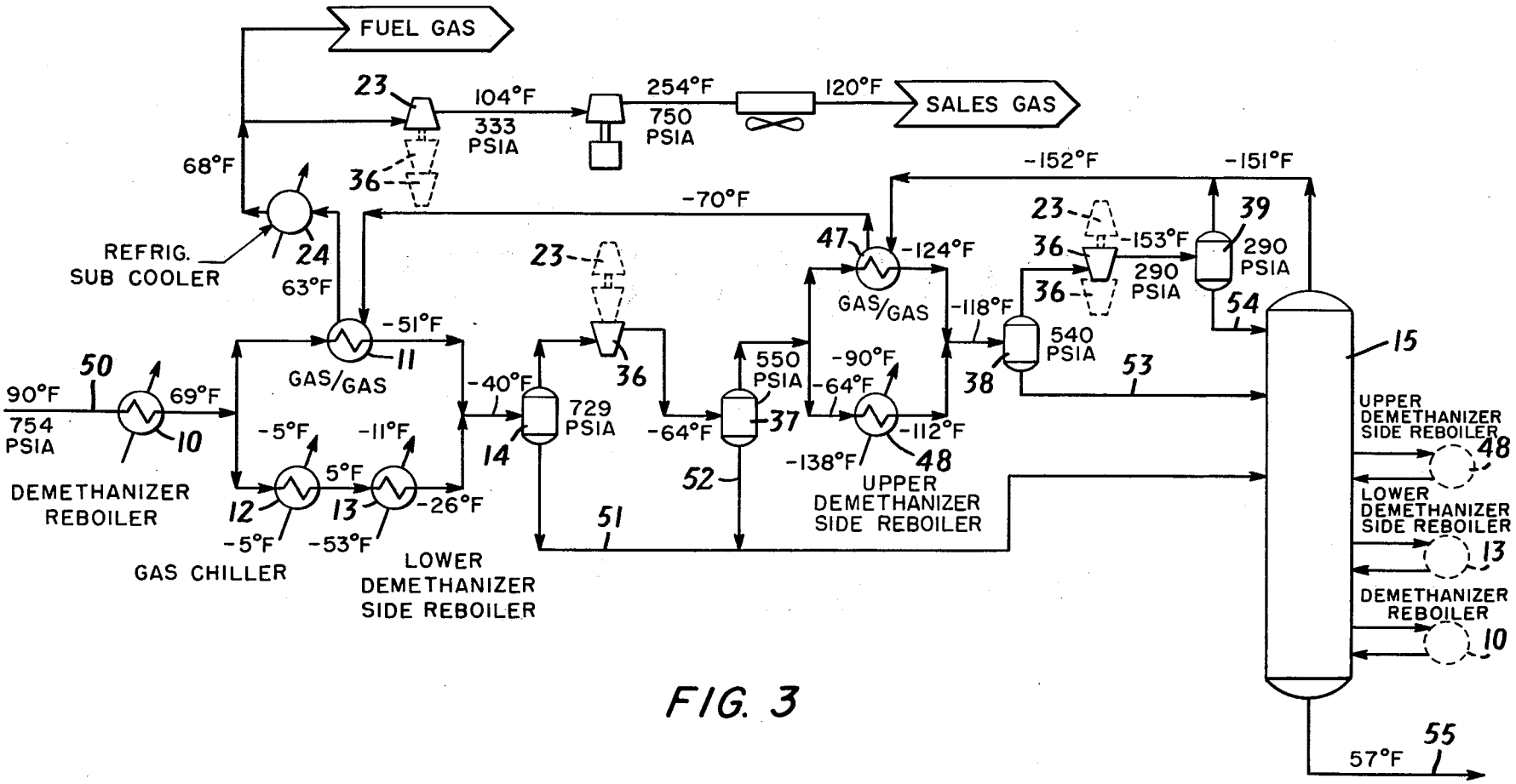
FIG. 3 is a flow diagram showing an embodiment of the present invention wherein the gas flowing through the first expander is split, the streams subjected separately to cooling and then recombined to pass to separation and the next succeeding expander.

A second embodiment of the process of the present invention is shown in FIG. 3. In this embodiment, the inlet gas is processed and cooled in a manner similar to that shown in the early stages of FIG. 1 to provide separation at −40° F. In accordance with the present invention, the gas stream is first carried to high pressure separator 14 where the condensed liquid is separated and fed on level control to demethanizer 15.

From the high pressure separator 14, the cold gas flows through the first stage of expander 36 where because of work expansion from 729 to 550 psia, the gas is chilled to −64° F. Liquid formed by expansion is separated from the gas as it flows through low pressure separator 37. The liquid fed on level control joins the liquid from high pressure separator 14 and flows to demethanizer 15 as its lowest feed.

Flowing from low pressure separator 37, the cold gas is split into two streams as it is chilled to −118° F by heat exchange with cold residue gas at −152° F, exchanger 47 and with −138° F demethanizer liquid at side reboiler 48. Approximately 70.6% of the stream enters cold gas/gas exchanger 47 while the remaining gas is chilled in upper demethanizer side reboiler 48. Leaving these two exchangers, the streams recombine and flow to a second low pressure separator 38 where condensed liquid is removed and fed on level control to demethanizer 15 as its middle feed.

The cold gas leaving low pressure separator 38 flows through the second stage of expander 36, where because of work expansion from 540 to 290 psia, the gas is chilled to −153° F. Cold liquid formed by the expansion in expander 36 is removed as the stream enters separator 39 prior to the demethanizer 15, and flows as top feed to the column.

The data for this case are given in the following tabulation:

Table IV

Stream Flow Rate Summary - Lb. Moles/Hr

| Stream | Methane | Ethane | Propane | Butanes+ | Total |
|---|---|---|---|---|---|
| 50 | 19,023 | 1,333 | 586 | 477 | 21,959 |
| 51 | 818 | 284 | 286 | 394 | 1,793 |
| 52 | 139 | 61 | 66 | 47 | 316 |
| 53 | 3,912 | 610 | 200 | 32 | 4,816 |
| 54 | 1,235 | 220 | 30 | 4 | 1,505 |
| 55 | 23 | 1,099 | 581 | 476 | 2,202 |

Recoveries

| | |
|---|---|
| Ethane | 82.4% |
| Propane | 99.2% |

Horsepower

| | BHP At Efficiency |
|---|---|
| Expander/Compressor | 2250 At 80%/73% |
| Final Compressor | 9917 At 73% |

Figure 4:
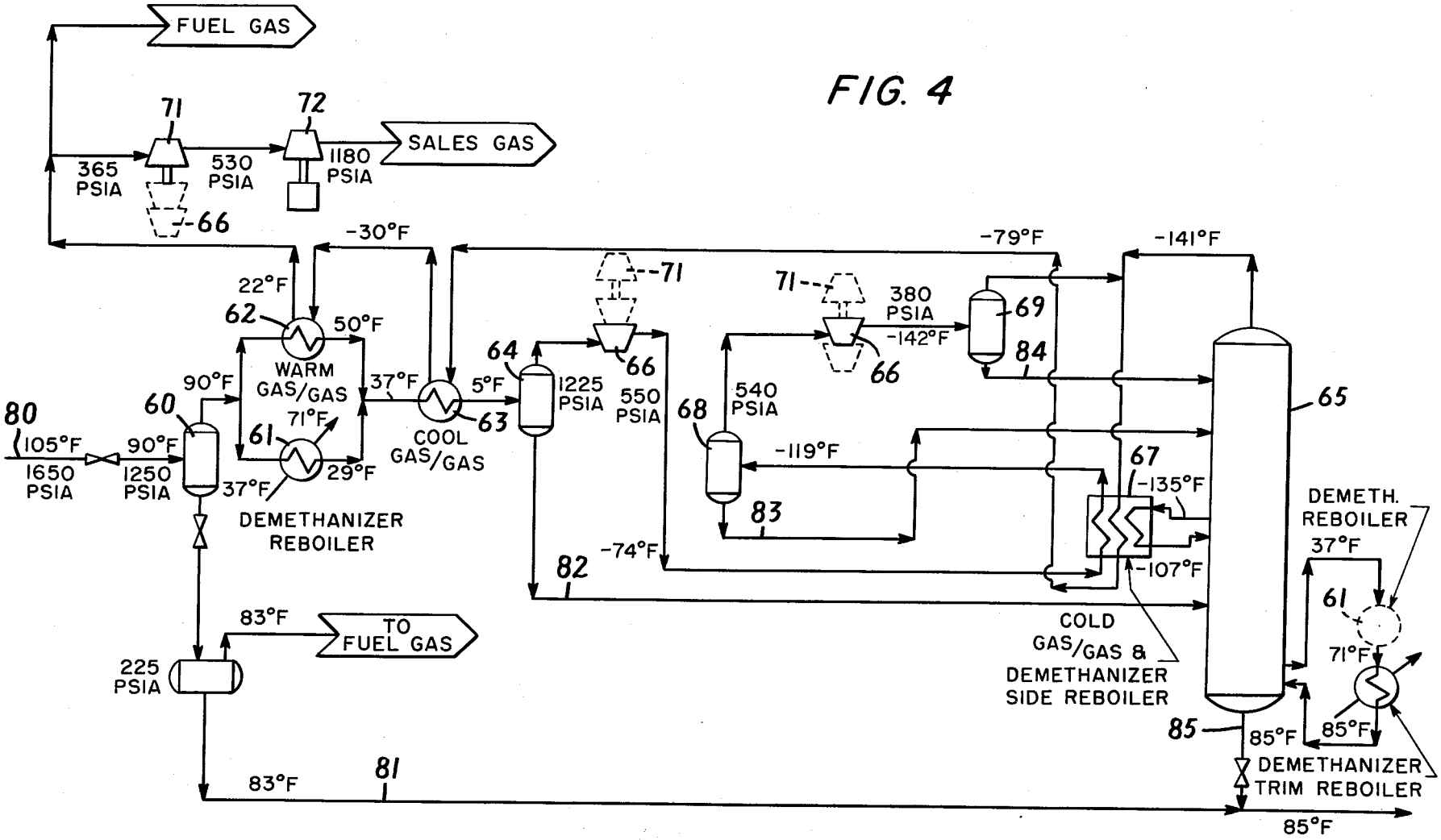
FIG. 4 is a flow diagram showing an embodiment of the present invention wherein two separate cooling by heat exchanger steps and liquid condensate removal steps are shown intermediate the expander stages.

A third embodiment of the invention is shown in FIG. 4. This embodiment represents a plant designed to recover approximately 74.4% of the available ethane and 95.4% of the available propane from 175 MMSCF/D of inlet gas while producing a residue gas with a gross heating value of 1001.8 BTU/CF (Sat. at 30" Hg. 60° F). The plant utilizes two stages of expansion, one from 1225 to 550 psia, and the second from 540 to 380 psia with additional gas cooling and liquid removal steps intermediate the expansion stages.

This plant design using a two stage expander has a number of advantages. It provides more horsepower for the same final expander outlet pressure and product recoveries, thus requiring less recompression horsepower. By expanding to an intermediate pressure of 600 psia, savings in equipment is provided in that plate-fin heat exhangers can be used, which are considerably less expensive than shell and tube heat exchangers in this type service.

In addition, we have found that a two stage expander design in accordance with this invention results in higher propane recovery for the same level of ethane recovery. This difference becomes more significant at lower ethane recoveries.

In addition, the two stage expander design minimizes the sensitivity of liquid recoveries at low temperature/-high pressure vapor-liquid equilibrium conditions, as set forth above.

Referring to FIG. 4, inlet dehydrated gas is supplied to the process at 1250 psia and 90° F. Incidental liquid is separated from the feed gas in the inlet separator 60 and processed in a manner to bypass the cryogenic process. The stream is then split into two parallel streams for a first cooling stage. One portion of the gas stream passes through demethanizer reboiler 61 where its temperature is reduced to 29° F. The first parallel stream is then recombined with the second parallel stream of gas that has just been cooled to 50° F by exchange with the cold residue gas at −30° F in exchanger 62. The recombined stream, at a temperature of 37° F, is then cooled to 5° F by passage through high pressure exchanger 63 and then flows to high pressure separator 64. The liquids from separator 64 flow on level control as the lower feed for demethanizer 65. The gas stream leaves the separator 64 at 5° F and flows to the first stage of expander 66 where because of work expansion from 1225 to 550 psia, the temperature of the stream is reduced to −74° F. The gas stream then flows through low pressure gas exchanger 67 where its temperature is reduced to −119° F by passing in heat exchange relation with demethanizer liquids and residue gases. The gas stream then flows to separator 68 where condensed liquid is separated and carried to demethanizer 65 as a middle feed. The cold gas leaving separator 68 flows to the second stage of expander 66 where because of work expansion from 540 to 380 psia, the gas is chilled to −142° F.

The stream then enters separator 69 where the cold liquid formed by expansion is separated and flows as top feed to the column. The gas from separator 69 is combined with demethanizer overhead vapor and becomes the cold residue gas stream.

As the liquid fed to the demethanizer flows down the column, it is contacted by vapors which strip the methane from the liquid to produce a demethanized liquid product. The heat required to generate stripping vapors is obtained by efficient heat exchange with inlet gases in two heat exchangers. Specifically, the two heat exchangers comprise the gas exchanger 67 and the demethanizer reboiler 61.

The demethanizer trim reboiler 70 which is not normally in operation is provided to assist the two primary reboilers during plant operations when sufficient heat cannot be obtained from the inlet gas due to a bottoms temperature higher than normally experienced. The bottom product of the demethanizer flows to fractionation or is pumped to pipeline.

In handling the residue gas, the vapors stripped from the condensed liquid in demethanizer 65 join the cold expander outlet gas at −142° F. The combined residue gas then flows back to exchanger 67 and exchangers 63 and 62, where it chills the inlet gases and is heated to 22° F. A portion of the gas is removed on demand for fuel and the balance is recompressed with compressors 71 and 72 to the final residue gas discharge pressure of 1180 psia.

Flow rates of inlet gas and of condensed liquids at the various points in the process are given in the following table together with product recoveries and compression requirements:

Table V

Stream Flow Rate Summary - Lb. Moles/Hr.

| Stream | Methane | Ethane | Propane | Butanes+ | Total |
|---|---|---|---|---|---|
| 80 | 18,210 | 507 | 194 | 281 | 19,210 |
| 81 | 3 | 1 | 2 | 47 | 53 |
| 82 | 111 | 12 | 11 | 87 | 221 |
| 83 | 4,140 | 335 | 159 | 141 | 4,784 |
| 84 | 878 | 67 | 17 | 5 | 968 |
| 85 | 13 | 377 | 185 | 231 | 814 |

Recoveries

| | |
|---|---|
| Ethane | 74.4% |
| Propane | 95.4% |

Horsepower at Efficiency

| | |
|---|---|
| Expander/compressor | 3566 At 80%/73% |
| Recompression | 8484 At 73% |

Figure 5:
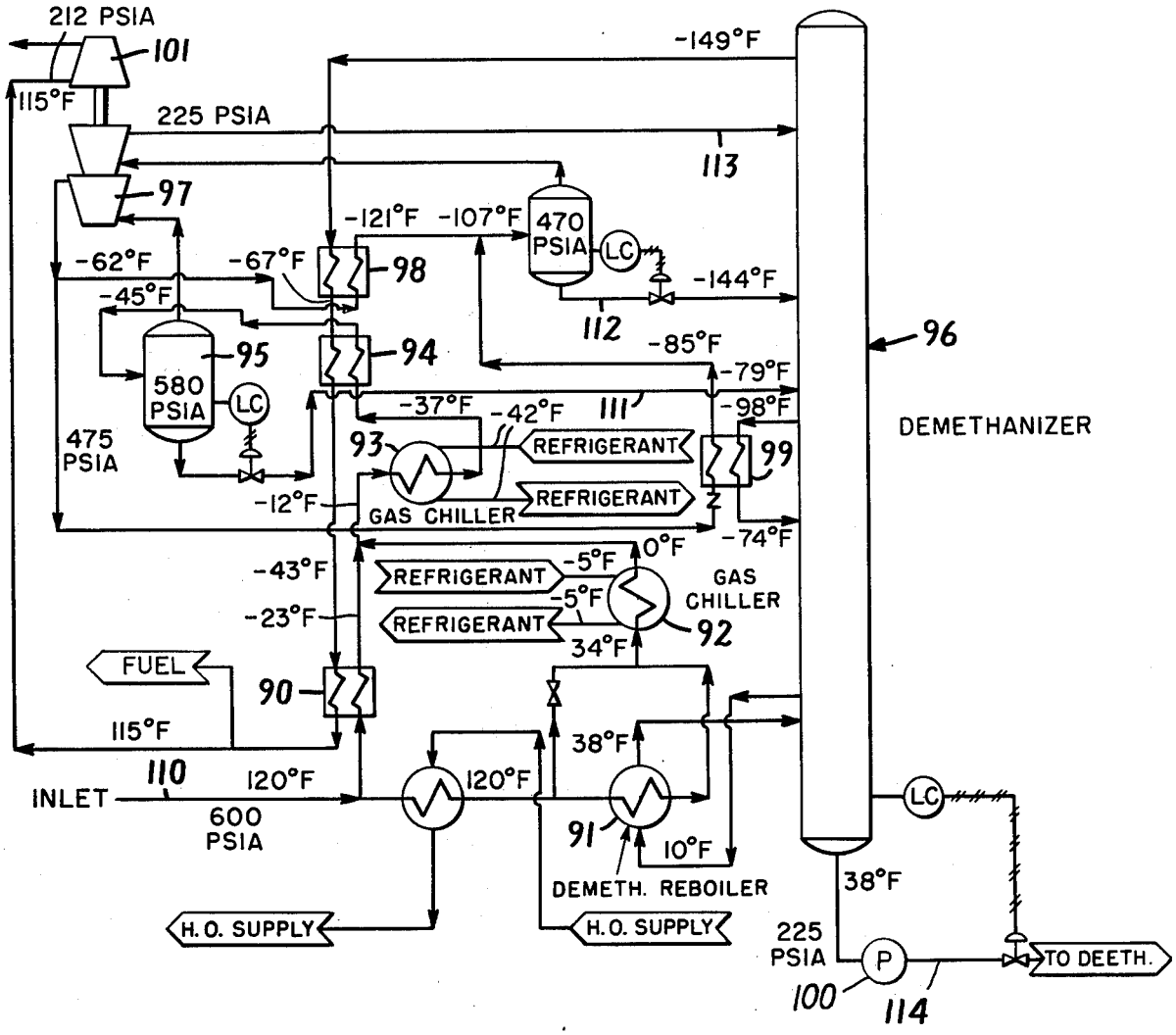
FIG. 5 is a flow diagram showing still another embodiment of the invention.

FIG. 5 shows still another embodiment of the present invention. In this case, the inlet gas has a pressure of about 600 psia and a temperature of 120° F. The gas is supplied in a water-free condition. The rich inlet gas is divided into two parallel streams as it is chilled to −12° F by heat exchange with cool residue gas at −43° F, exchanger 90, 10° F demethanizer liquid, reboiler 91 and −5° F propane refrigerant, gas chiller 92. To accomplish this, approximately 52.5% of the inlet stream flows to exchanger 90, while the remaining gas is chilled in demethanizer reboiler 91 and gas chiller 92. From these exchangers, the streams recombine and flow through a second gas chiller 93 and exchanger 94 where the inlet gas is further chilled to −45° F by exchange with −67° F residue gas. The chilled gas then flows to high pressure separator 95 where the condensed liquid is separated and fed on level control to demethanizer 96 as its lowest feed.

From the high pressure separator 95, the cold gas flows through the first stage of expander 97 where because of work expansion from 580 to 475 psia, some liquid is formed as the gas is chilled to −62° F. Flowing from the expander, the gas is split into two streams as it is chilled to −107° F by heat exchange with cold residue gas at −149° F in exchanger 98 and with −98° F demethanizer liquid, reboiler 99. Approximately 50.2% of the stream enters exchanger 98 while the remaining gas is chilled in upper demethanizer side reboiler 99. Leaving these two exchangers, the streams are recombined and after separation the gas flows through the second stage of expander 97 where because of work expansion from 470 to 225 psia, the gas is chilled to −150° F. Cold liquid formed by expansion is removed as the stream enters the separation section at the top of the demethanizer 96 and flows from the chimney tray as top feed to the column.

As the liquid fed to the demethanizer flows down the column, it is contacted by vapors which strip the methane from the liquid to produce a demethanized liquid product at the bottom. The heat required to generate stripping vapors is obtained by efficient heat exchange with inlet gas in two exchangers. Approximately 24.3% of the total heat requirement is provided by upper demethanizer side reboiler 99 with the remaining duty provided by demethanizer reboiler 91.

The demethanized product is pumped on level control by deethanizer feed pump 100 to the deethanizer (not shown) where the product is fractionated into an ethane-propane mix and a propane-plus product.

The vapors stripped from the condensed liquid in demethanizer 96 join the cold expander outlet gas at −150° F in the top of the column. The combined residue gas at −149° F then flows back to exchangers 98 and 94 and exchanger 90 where it chills the inlet gas as it is heated to 115° F.

Leaving the last exchanger, a portion of the warmed residue gas is sent to a fuel gas system on demand of the fuel gas make-up regulators. The residue gas that is not required for fuel is compressed in compressor 101 to 266 psia utilizing the power developed by expander 97. The gas is then compressed to the final residue gas pressure of 774 psia by compressors and cooled to 120° F before entering the sales gas pipe line.

Flow rates of the inlet gas and of condensed liquids at the various points in the process are given in the following table together with component recovery efficiencies and compression requirements:

Table VI

Stream Flow Rate Summary - Lb. Moles/Hr

| Stream | Methane | Ethane | Propane | Butanes+ | Total |
|---|---|---|---|---|---|
| 110 | 2,618 | 349 | 167 | 99 | 3,294 |
| 111 | 223 | 140 | 122 | 94 | 581 |
| 112 | 307 | 115 | 38 | 6 | 470 |
| 113 | 85 | 44 | 6 | 0 | 137 |
| 114 | 5 | 283 | 166 | 99 | 556 |

Recoveries

| | |
|---|---|
| Ethane | 81.1% |
| Propane | 99.4% |

Horsepower

| | BHP At Efficiency |
|---|---|
| Expander/Compressor | 368 At 80%/73% |
| Final Compressor | 1980 |

Figure 6:
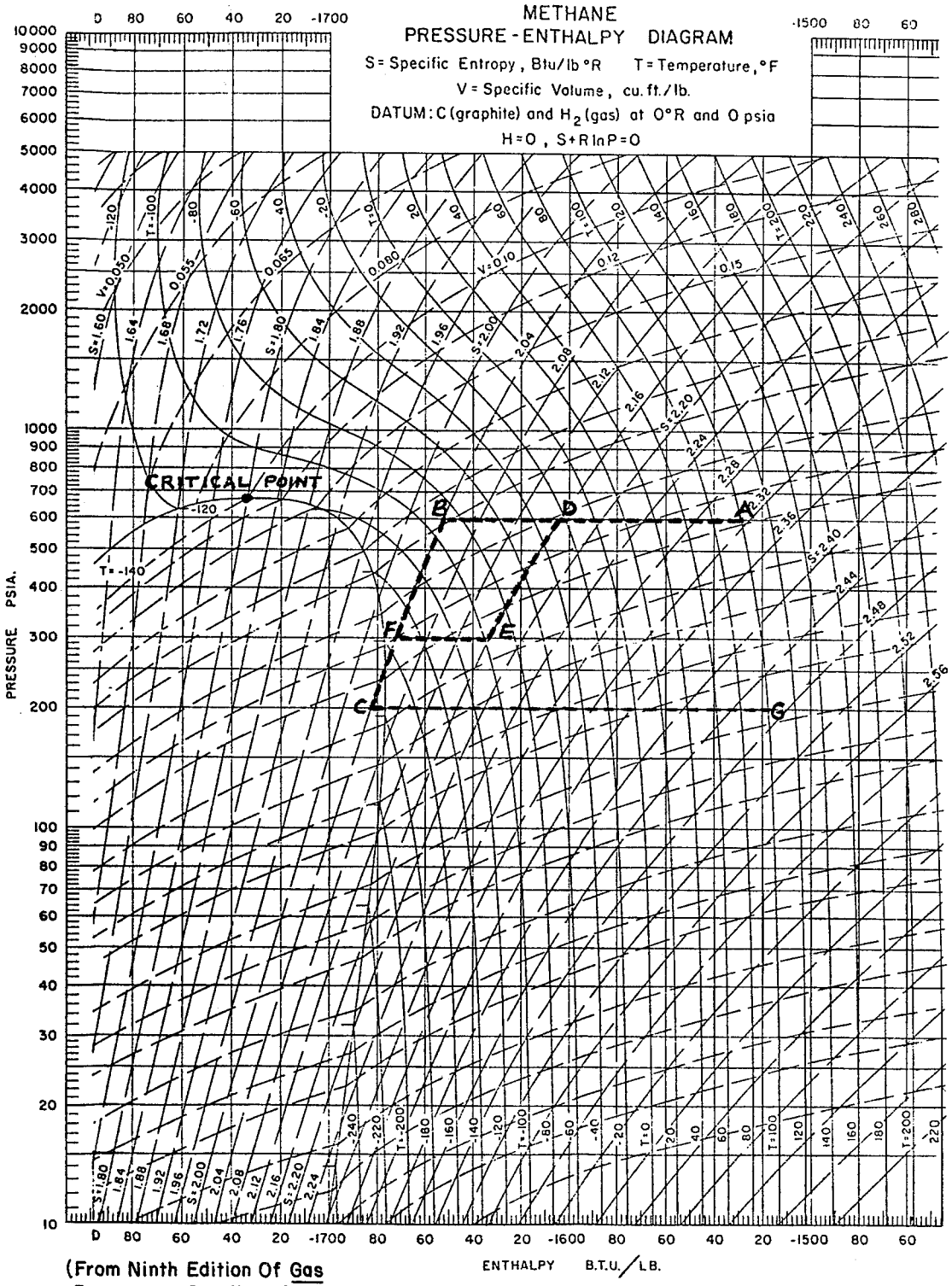
FIG. 6 is a pressure-enthalpy diagram for methane, used to illustrate the thermodynamic advantages of the process of this invention.

A description of the thermodynamic advantages of the multistage expansion process of the present invention over the single stage expansion processes of the prior art is presented with reference to FIG. 6 which is a pressureenthalpy diagram for pure methane. In practice, a multicomponent gas will be processed, but to simplify the illustration of the benefits of this invention, a pure methane stream is described. Two expansion paths have been delineated on the diagram: (1) the constant pressure cooling step from point A to B followed by constant entropy expansion from B to C corresponds to a single stage expansion process; (2) the constant pressure cooling steps from point A to D and from E to F followed by corresponding constant entropy expansions from D to E and from F to C constitute a two stage expansion. The reheat step from point C to G is common to both paths.

Due to the reduction in slope of the constant entropy lines with increasing temperature, the path from D to E entails a greater enthalpy change per pound of methane expanded than does the path from B to F. This also means that the path from E to F requires less enthalpy change per pound of methane cooled than does the path from D to B. From this, it will be seen that two benefits occur, namely, that there is more refrigeration available from the system, and secondly, that there is more work energy available from the system.

The first improvement depicted in this illustration is in available refrigeration and is calculated as follows: Increase in refrigeration of two stage over single stage = (Refrigeration due to reheat − Two stage chilling duty) − (Refrigeration due to reheat − Single stage chilling duty) The ratio of this increase to the last term represents the net improvement in refrigeration offered by the two stage process. Numerically from this illustration the ratio is $$\frac{CG - (AD + EF) - (CG - AB)}{CG - AB} = \frac{165 - (76 + 40) - (165 - 125)}{165 - 125} = .225$$

Or, on a percentage basis, the increase is approximately 22.5%.

The second improvement depicted in this illustration is in the expansion energy and is calculated as follows:

Increase of two stage over single stage energy = (two stage enthalpy change × efficiency) − (single stage enthalpy change × efficiency). The efficiency illustrated here is 100%., although it may be expected to be something less than this in practice. However, it would be essentially constant for all expansion paths considered in a given case, and therefore its magnitude does not affect the ratio of the increase to the single stage energy derived. The small adjustment in expansion paths to correct for true efficiency will affect only slightly the net improvement in available refrigeration calculated under the first improvement described above. Thus the theoretical increase in developed energy is truly indicative of the increase in energy output realized. Numerically from this illustration the ratio is $$\frac{DE + FC - BC}{BC} = \frac{29 + 10 - 30}{30} = 0.300$$

Or, on a percentage basis, the increase is approximately 30%.

For simplification this illustration has been taken as single component kept neatly in the single phase region (except where the last step common to both paths enters slightly into the two-phase region). However, the overall expansion ratio (initial absolute pressure divided by final absolute pressure) of about 3 to 1 and the second stage ratio of about 1.5 to 1 are similar to those encountered in actual practice. It is also normally expected that the two-phase region is encountered between points A and D in a typical application of the present invention. Nevertheless the principle is applicable, such that multistage work and refrigeration available are greater than that for single stage.

Referring again to the methane pressure-enthalpy diagram in FIG. 6, the critical point of the system has been noted where the critical temperature, critical pressure and critical volume converge on the phase envelope. The closer a design point is to the critical the less predictable is the performance of the system. Multistage expansion process of this invention offers the advantage of having important design points that are farther removed from the critical. The path DEF avoids this region in a manner superior to path DBF.

We claim:

1. In a process for obtaining a liquified fraction from a main stream of gas containing hydrocarbons selected from the group consisting of natural gas, refinery gas streams, and synthetic gas streams obtained from coal, crude oil, naphtha, oil shale, tar sands, and lignite which comprises the steps of
   a. removing carbon dioxide, sulfur-containing gases, and other undesirable contaminants;
   b. dehydrating the gas stream;
   c. expanding said gas stream to a pressure lower than the previously existing pressure while extracting energy from the gas to provide a stream comprising gas and liquid portions; and
   d. separating the resulting cold stream into residue gas and liquid portions, the improvement consisting in the steps of:
   1. expanding said gas stream in step (c) in at least two separate stages, each expansion stage being conducted at pressure-temperature conditions which cause hydrocarbons to condense;
   2. directing the gas stream flowing from the first of said expansion stages to a condensed liquid separator where condensed liquid is separated and carried to a demethanizer;
   3. directing the gas portion of the stream after separation in step (2) above into two vapor streams for further cooling, one of said streams flowing in heat exchange relationship with residue gas of lower temperature and the other of said streams flowing in heat exchange relationship with demethanizer liquid of lower temperature;
   4. recombining the thus-cooled streams;
   5. separating the liquid condensed by said further cooling step;
   6. carrying the condensed liquid to a demethanizer;
   7. directing the gas portion of the stream obtained in (5) above to the next expansion stage;
   8. separating the stream leaving the said next expansion stage into gas and liquid portions;
   9. directing the gas portion, from the separation following said next expansion stage, together with discharge gas from the demethanizer, into heat exchange relationship with at least one of the two vapor streams in (3) above; and
   10. directing the liquid portion obtained in (8) above to a demethanizer.

2. In a process for separating a feed gas into a liquid product portion and a residue gas, said feed gas containing hydrocarbons and having methane and ethane as its major components, said process including the steps of
   a. cooling said feed gas under substantially constant pressure;
   b. expanding at least a portion of said cooled gas stream to a lower pressure while extracting energy from said gas portion to provide a partially condensed cold stream; and c. treating at least the resulting partially condensed cold stream in a distillation column at said lower pressure to obtain said liquid product portion, the improvement wherein said gas stream portion is expanded in step (b) in at least two separate stages by a process wherein 1. said portion of said cooled gas stream under pressure (a) is expanded in a first expansion means to an intermediate pressure while extracting energy from the gas, the outlet conditions of temperature and pressure in said first expansion stage being effective to cause the expanded feed gas portion to partially condense;
2. further cooling at least the gas remaining from said partial condensation immediately following said expansion in step (1) at a substantially constant pressure at said intermediate pressure;
3. separating said further cooled gas into a first vapor fraction at intermediate pressure and a first liquid fraction;
4. further expanding said first vapor fraction at said intermediate pressure in a second expansion stage, the outlet conditions of temperature and pressure in said second expansion stage being effective to cause hydrocarbons in the expanded vapor fraction to partially condense into a second gas and liquid portion;
5. separating said second liquid portion following said second expansion stage; and
6. thereafter treating said first and second liquid fractions in said distillation column (c) at said lower pressure.

3. The process of claim 2, wherein the expansion ratio of the process over all expansion stages combined is not in excess of about 5:1.

4. The process of claim 2, wherein i. the liquid portion from step (*b*) thereof is demethanized and the methane returned to the residue gas stream, ii. the cold residue gas stream is utilized for refrigeration by passing it in heat exchange relation with the main stream of gas, iii. the cold liquids condensed from the main stream of gas are utilized for refrigeration by passing them in heat exchange relation with the main stream of gas, and iv. the horsepower created by expansion of said gases through the at least two separate stages is utilized.

5. The process of claim 4, wherein the expansion ratio of the process over all expansion stages combined is not in excess of 5:1.

6. The process of claim 4, wherein the horsepower created by expansion of said gases through the at least two separate stages is utilized to recompress the warmed residue gas stream.

7. The process of claim 1, wherein a gas cooling step using heat exchange with lower temperature residue gas, condensed liquid, external refrigeration, or any combination thereof is employed between each gas expansion stage prior to recovery of said condensed liquid.

8. The process of claim 2 wherein the feed gas containing hydrocarbons is a stream of natural gas.

9. The process of claim 8 wherein the expansion ratio over all expansion stages combined is not in excess of about 5:1.

10. In an apparatus for separating a feed gas into a liquid product portion and residue gas, said feed gas containing hydrocarbons and having methane and ethane as its major components, said apparatus including a. means for cooling said feed gas under pressure at a substantially constant pressure;

b. expansion means connected to said cooling means to receive at least a portion of said cooled feed gas under pressure and to expand said gas portion to a lower pressure while extracting energy therefrom, said expansion means being adapted to partially condense said gas portion and to provide a cold gas stream; and c. distillation means connected to said expansion means for receiving at least said partly condensed cold gas stream at said lower pressure, said distillation means being adapted to produce said liquid product portion, the improvement wherein said expansion means (b) comprises 1. a first expansion means for expanding said gas stream portion to a pressure intermediate between the pressure of said feed gas and said lower pressure while extracting energy from the gas, said first expansion means being adapted to provide outlet conditions of temperature and pressure effective to cause hydrocarbons to partially condense from the gas stream portion at said intermediate pressure;
2. further cooling means connected directly to receive at least the gas remaining in said partially condensed feed stream from said first expansion means for further cooling the stream flowing from said first expansion means at a substantially constant pressure;
3. separation means connected to said further cooling means to receive the partially expanded and further cooled gas stream at said intermediate pressure and to separate it into a first liquid portion and first vapor portion;
4. a second expansion means connected to said separation means to receive said first vapor portion and to further expand it while extracting energy therefrom, said second expansion means being adapted to provide outlet conditions of temperature and pressure effective to cause hydrocarbons to partially condense from the further expanded gas stream;
5. separation means for removing a second liquid portion from the further expanded gas following said second expansion stage; and
6. means to receive said first and second liquid portions and supply them to said distillation column (c) at said lower pressure.

* * * * *

UNITED STATES PATENT AND TRADEMARK OFFICE

CERTIFICATE OF CORRECTION

PATENT NO. : 4,061,481

DATED : December 6, 1977

INVENTOR(S) : Roy E. Campbell et al.

It is certified that error appears in the above-identified patent and that said Letters Patent are hereby corrected as shown below:

Col. 5, line 3, "47721,959" should read --477-- under "Butanes+" and --21,959-- under "Total"

Col. 8, lines 54 and 55, lines 54 and 55 should read as follows:

| | --BHP At Efficiency |
|---|---|
| Expander/Compressor | 368 At 80%/73%-- |

Col. 11, line 59, "claim 1" should be --claim 2--

Signed and Sealed this

Twenty-eighth Day of March 1978

[SEAL]

Attest:

RUTH C. MASON
Attesting Officer

LUTRELLE F. PARKER
Acting Commissioner of Patents and Trademarks

REEXAMINATION CERTIFICATE (313th)

United States Patent [19] [11] B1 4,061,481

Campbell et al. [45] Certificate Issued Mar. 19, 1985

[54] NATURAL GAS PROCESSING

[75] Inventors: Roy E. Campbell; John B. Lawrence; Ronald R. Tonne, all of Midland, Tex.

[73] Assignee: The Ortloff Corporation, Midland, Tex.

Reexamination Request:
No. 90/000,077, Sep. 30, 1981

Reexamination Certificate for:

| | |
|---|---|
| Patent No.: | **4,061,481** |
| Issued: | **Dec. 6, 1977** |
| Appl. No.: | **723,513** |
| Filed: | **Sep. 15, 1976** |

Certificate of Correction issued Mar. 28, 1978.

Related U.S. Application Data

[63] Continuation of Ser. No. 516,993, Oct. 22, 1974, abandoned.

[51] Int. Cl.[3] ..... F25J 3/02

[52] U.S. Cl. ..... 62/29; 62/31; 62/33; 62/34; 62/38

[58] Field of Search ..... 62/26, 30, 34, 38, 39

[56] References Cited

U.S. PATENT DOCUMENTS 3,516,261 6/1970 Hoffman ..... 62/24

*Primary Examiner*—Frank Sever

[57] ABSTRACT

The processing of gas streams containing hydrocarbons and other gases of similar volatility to recover high yields of components such as ethane, propane, and heavier hydrocarbons therefrom by expanding said gas stream in at least two stages through turboexpanders, each stage cooling the gas stream and producing energy in the form of horsepower used to drive a recompressor unit or other mechanical apparatus. Condensed liquids are collected intermediate the expansion stages. Preferably, a supplemental gas cooling stage and condensed liquid recovery occurs following each expansion stage.

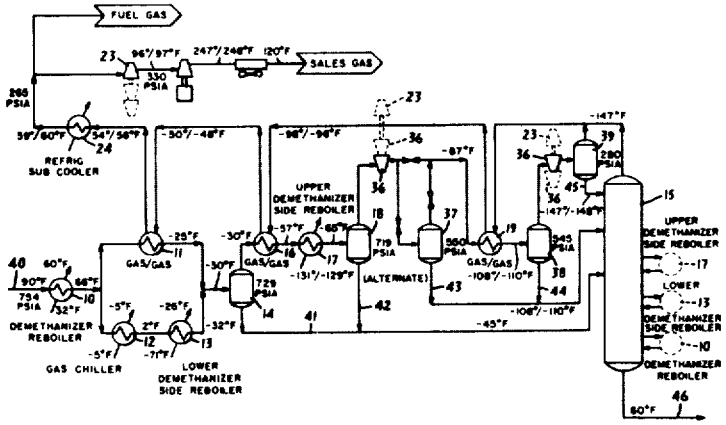

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, and 10 are determined to be patentable as amended.

Claims 3-9, dependent on an amended claim, are determined to be patentable.

New claim 11 is added and determined to be patentable.

1. In a process for obtaining a liquified fraction from a main stream of gas containing hydrocarbons selected from the group consisting of natural gas, refinery gas streams, and synthetic gas streams obtained from coal, crude oil, naphtha, oil shale, tar sands, and lignite which comprises the steps of a. removing carbon dioxide, sulfur-containing gases, and other undesirable contaminants;

b. dehydrating the gas stream;

c. expanding said gas stream to a pressure lower than the previously existing pressure while extracting energy from the gas to provide a stream comprising gas and liquid portions; and d. separating the resulting cold stream *in a demethanizer* into residue gas and liquid portions, the improvement consisting in the steps of:

(1) expanding said gas stream in step (c) in at least two separate stages, each expansion stage being conducted at pressure-temperature conditions which cause hydrocarbons to condense;

(2) directing the gas stream flowing from the first of said expansion stages to a condensed liquid separator where condensed liquid is separated and carried to *said* [a] demethanizer *and supplied thereto at an intermediate feed position;*

(3) directing the gas portion of the stream after separation in step (2) above into two vapor streams for further cooling, one of said streams flowing in heat exchange relationship with residue gas of lower temperature and the other of said streams flowing in heat exchange relationship with demethanizer liquid of lower temperature;

(4) recombining the thus-cooled streams;

(5) separating the liquid condensed by said further cooling step;

(6) carrying the condensed liquid to *said* [a] demethanizer;

(7) directing the gas portion of the stream obtained in (5) above to the next expansion stage;

(8) separating the stream leaving the said next expansion stage into gas and liquid portions;

(9) directing the gas portion from the separation following said next expansion stage, together with discharge gas from the demethanizer, into heat exchange relationship with at least one of the two vapor streams in (3) above; and

(10) directing the liquid portion obtained in (8) above to demethanizer.

2. In a process for separating a feed gas into a liquid product portion and a residue gas, said feed gas containing hydrocarbons and having methane and ethane as its major components, *said liquid product portion containing a major portion of the ethane and said residue gas containing a major portion of the methane,* said process including the steps of:

a. cooling said feed gas under substantially constant pressure *sufficiently to at least partially condense it forming thereby a high pressure vapor portion and a high pressure liquid portion;* b. expanding [at least a portion of said cooled gas stream] *said high pressure vapor portion* to a lower pressure while extracting energy [from said gas portion] *therefrom* to provide a partially condensed cold stream; and c. treating at least *a portion of* the resulting partially condensed cold stream in a distillation column at said lower pressure to obtain said liquid product portion *as the column bottom liquid and the residue gas as the column overhead vapor;* the improvement wherein [said gas stream portion] *said high pressure vapor portion* is expanded in step (b) in at least two separate stages by a process wherein;

(1) said [portion of said cooled gas stream under pressure (a)] *high pressure vapor portion* is expanded in a first expansion means to an intermediate pressure while extracting energy [from the gas] *therefrom*, the outlet conditions of temperature and pressure in said first expansion stage being effective to cause the expanded [feed gas portion] *high pressure vapor portion* to partially condense;

(2) further cooling at least *part of* the gas remaining from said partial condensation immediately following said expansion in Step (1) at a substantially constant pressure *by directing said gas portion at intermediate pressure into heat exchange relation with residue gas from the overhead from said distillation column the residue gas entering said heat exchange relation at substantially the temperature at which it leaves the distillation column, whereby a portion of the gas at the intermediate pressure is condensed* [at said intermediate pressure];

(3) separating said further cooled gas into a [first] vapor fraction at *said* intermediate pressure and a [first] liquid fraction *at said intermediate pressure;*

(4) further expanding said [first] vapor fraction at said intermediate pressure in a second expansion stage, the outlet conditions of temperature and pressure in said second expansion stage being effective to cause hydrocarbons in the expanded vapor fraction to partially condense into a second gas and liquid portion;

(5) separating said second liquid portion following said second expansion stage; [and]

*(6) supplying the liquid portion obtained from second expansion stage in Step (5) as the top liquid feed to said distillation column;*

*(7) expanding the liquid portion at said intermediate pressure obtained in Step (3) to substantially the operating pressure of said liquid column and supplying the expanded liquid to said column at a first intermediate feed position which is below the top column liquid feed to said distillation column; and* [6] *(8)* thereafter treating said [first and second] liquid [fractions] *portions* in said distillation column [(c)] at said lower pressure *to recover said liquid product portion as the column bottom liquid and said residue gas as the column overhead vapor.*

10. In an apparatus for separating a feed gas into a liquid product portion and residue gas, said feed gas containing hydrocarbons and having methane and ethane as its major components, said apparatus including a. means for cooling said feed gas under pressure at a substantially constant pressure *sufficiently to at least partially condense it, forming thereby a high pressure vapor portion and a high pressure liquid portion;* b. expansion means connected to said cooling means to receive at least a portion of [said cooled feed gas under pressure] *said high pressure vapor portion* and to expand [said gas portion] *it* to a lower pressure while extracting energy therefrom, said expansion means being adapted to partially condense [said gas portion] *it* and to provide a cold gas stream; and c. distillation means connected to said expansion means for receiving at least said partly condensed cold gas stream at said lower pressure, said distillation means being adapted to produce said liquid product portion[,] *and said residue gas, said liquid product portion containing a major portion of the ethane and said residue gas containing a major portion of the methane,* the improvement wherein said expansion means (b) comprises (1) A first expansion means [for expanding said gas stream] *connected to receive and to expand said high pressure vapor* portion to a pressure intermediate between the pressure of said feed gas and said lower pressure while extracting energy from the gas, said first expansion means being adapted to provide outlet conditions of temperature and pressure effective to cause hydrocarbons to partially condense from the gas stream portion at said intermediate pressure;

(2) further cooling means connected directly to receive at least *part of* the gas remaining in said partially condensed feed stream from said first expansion means [for] *said* further cooling *means being adapted to cool* the stream flowing from said first expansion means at a substantially constant pressure[;] *by directing said gas portion at intermediate pressure into heat exchange relation with residue gas from the overhead of said distillation means which residue gas is at substantially the temperature at which it leaves the distillation means, said further cooling means being adapted thereby to condense a portion of the gas at the intermediate pressure;*

(3) separation means connected to said further cooling means to receive the partially expanded and further cooled gas stream at said intermediate pressure and to separate it into a first liquid portion and first vapor portion;

(4) a second expansion means connected to said separation means to receive said first vapor portion and to further expand it while extracting energy therefrom, said second expansion means being adapted to provide outlet conditions of temperature and pressure effective to cause hydrocarbons to partially condense from the further expanded gas stream;

(5) separation means for removing a second liquid portion from the further expanded gas following said second expansion stage; and (6) means to receive *said high pressure liquid portion and* said first and second liquid portions and supply them to said distillation column (c) at said lower pressure *said high pressure liquid portion and said first liquid portion being supplied to at least one intermediate column feed position.*

*11. The process of claim 2, wherein said high pressure liquid portion obtained in Step (a) thereof is expanded to substantially the column operating pressure and wherein said expanded liquid is supplied to the distillation column at a second intermediate feed position which is below the first intermediate feed position.*

* * * * *